US005899821A

United States Patent [19]

Hsu et al.

[11] Patent Number: 5,899,821

[45] Date of Patent: May 4, 1999

[54] GOLF CLUB HEAD

[75] Inventors: Tsai-Fu Hsu, No. 386, Liao Ning 1st Street, San Min District, Kaohsiung; Kuang-Wei Chen, Kaohsiung Hsien, both of Taiwan

[73] Assignees: Chien Ting Precision Casting Co. Ltd, Ping Tung; Tsai-Fu Hsu, Kaohsiung Hsien, both of Taiwan

[21] Appl. No.: 08/929,402

[22] Filed: Sep. 15, 1997

[51] Int. Cl.[6] ..... A63B 53/04

[52] U.S. Cl. ..... 473/332; 473/345; 473/350

[58] Field of Search ..... 473/324, 329, 473/332, 349, 350, 345; 273/DIG. 14, DIG. 23

[56] References Cited

U.S. PATENT DOCUMENTS 4,355,808 10/1982 Jernigan ..... 473/350
5,064,197 11/1991 Eddy ..... 473/332
5,178,392 1/1993 Santioni ..... 273/DIG. 14
5,244,211 9/1993 Lukasiewicz ..... 473/332
5,637,045 6/1997 Igarashi ..... 473/332

*Primary Examiner*—Sebastiano Passaniti
*Attorney, Agent, or Firm*—Rosenberg, Klein & Bilker

[57] ABSTRACT

A golf club head includes a head body having a front flat surface as a striking face and a hollow room formed behind the front surface and a rear cap. The rear cap is pushed in the hollow room contacting with an annular edge of the hollow room, fixedly closed on the opening of the hollow room, and welded together with the head body. Then liquid non-metal material is filled in a hollow pinched layer formed between the rear cap and the hollow room, becoming a buffer block after cooled. The buffer block has a proper softness and hardness, absorbing vibration of a ball to give stability to the golf club when the ball is hit by the golf club head.

4 Claims, 3 Drawing Sheets

GOLF CLUB HEAD

BACKGROUND OF THE INVENTION

This invention concerns a golf club head, particularly having a buffer block therein for absorbing vibration of a ball hit so as to augment stability of the golf club in hitting a golf ball.

A conventional golf club head shown in FIG. 6 is a very common one, formed by molding process and having a head body 10 with a different thickness according to the head number and a striking face 101 formed on a front side of the head body 10.

The conventional golf club head has a very large hardness so that the club head produces vibration at the moment when the club head hits a golf ball, affecting stability of the club. Then if a user should hold the golf club in an incorrect posture, he/she might suffer from sport harm or injury.

SUMMARY OF THE INVENTION

The purpose of the invention is to offer a golf club head improved in the disadvantage of the conventional ones above mentioned.

A feature of the invention is a hollow pinched layer formed in hollow room formed behind a striking face of a head body.

Another feature of the invention is a buffer block formed in the pinched layer for absorbing vibration of golf club head so as to augment stability of the golf club in hitting a golf ball.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
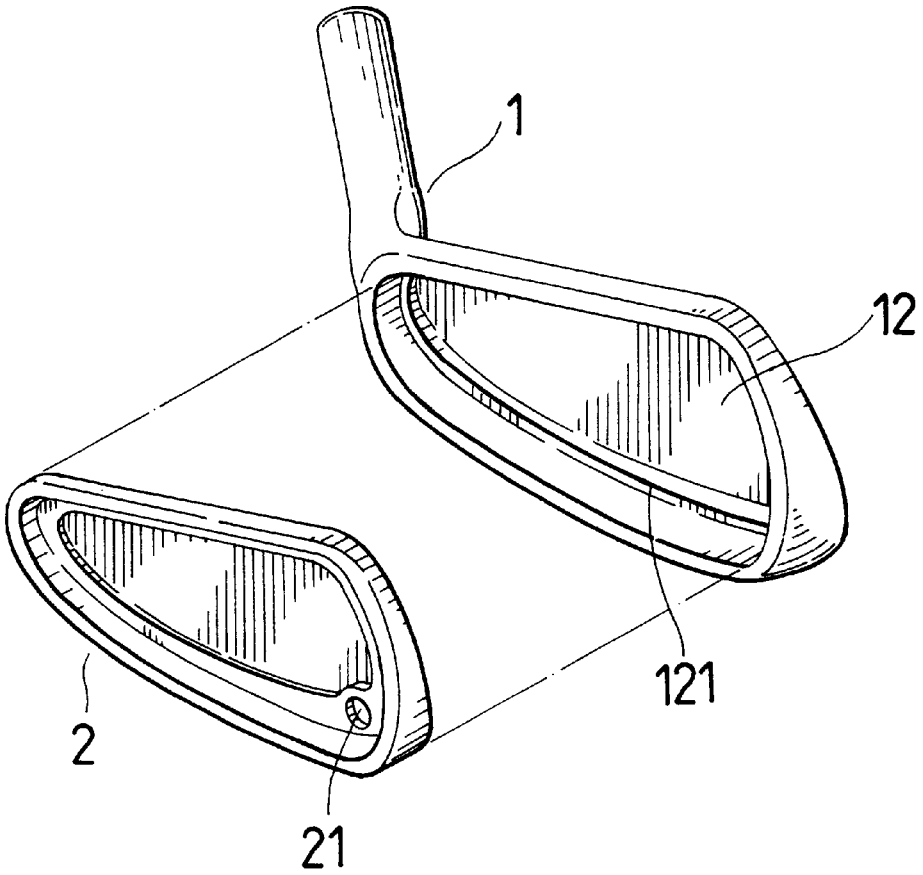
FIG. 1 is an exploded perspective view of a golf club head in the present invention.

A preferred embodiment of a golf club head in the present invention, as shown in FIG. 1, includes a head body 1 and a rear cap 2 combined together by welding process.

Figure 2:
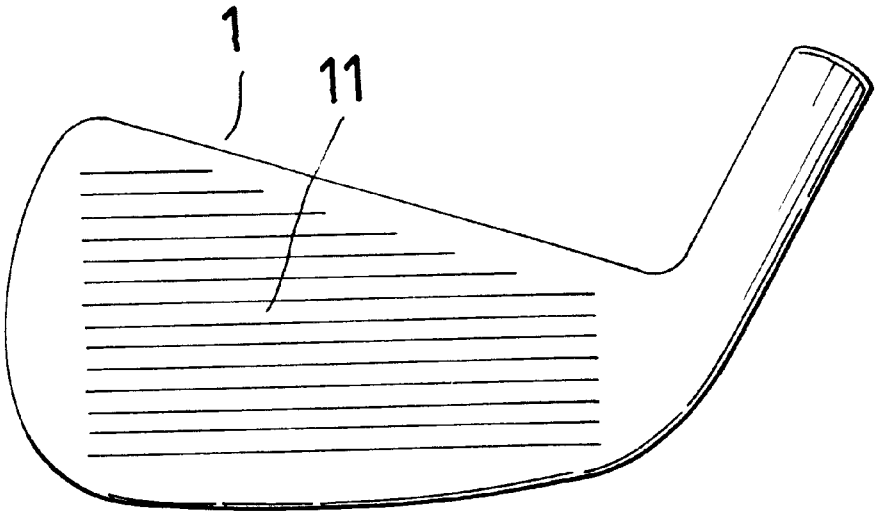
FIG. 2 is a front view of the golf club head in the present invention.

The head body 1 has a front flat face with plural cut lines to form a striking face 11, as shown in FIG. 2, and the thickness of the striking face 11 is in the scope of 1.4 mm–2 mm, and a hollow room 12 formed behind the striking face 11 and having a stair shape, a proper inclined angle and an annular projecting edge 121 on an inner surface.

The rear cap 2 has a complementary contour as the hollow room 12 of the head body 1, and closes in an opening of the hollow room 12 tightly, having a hole 21 in a proper point.

Figure 4:
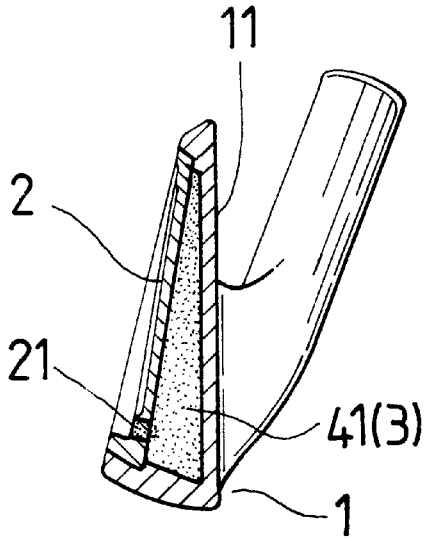
FIG. 4 is a cross-sectional view of the golf club head filled with the non-metal material in the pinched layer.
Figure 6:
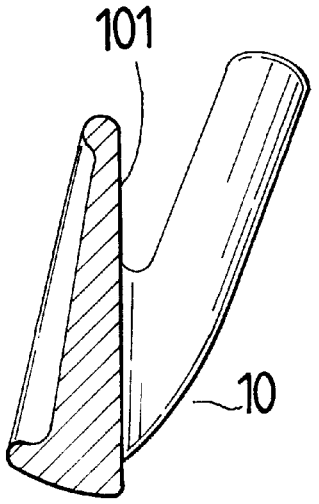
FIG.6 (PRIOR ART)
FIG. 6 is a side cross-sectional view of a conventional golf club head.
Figure 5:
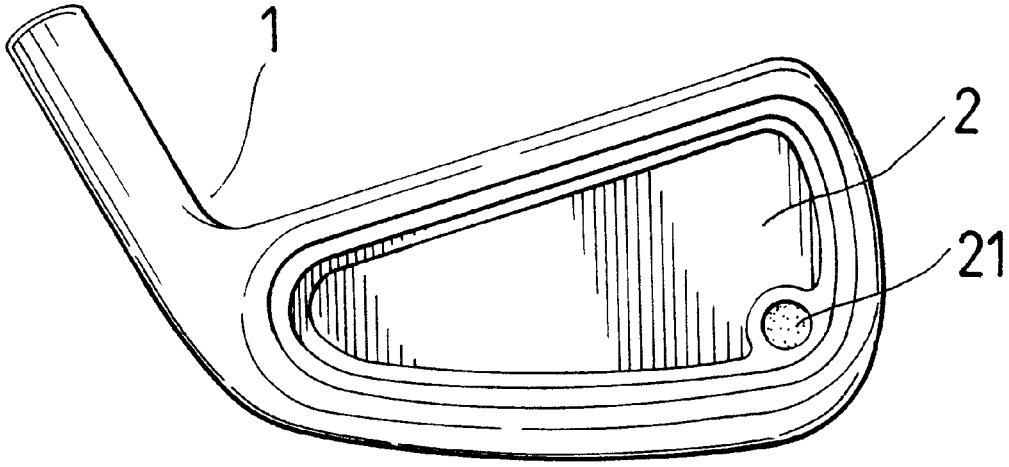
FIG. 5 is a rear view of the golf club head in the present invention.
Figure 3:
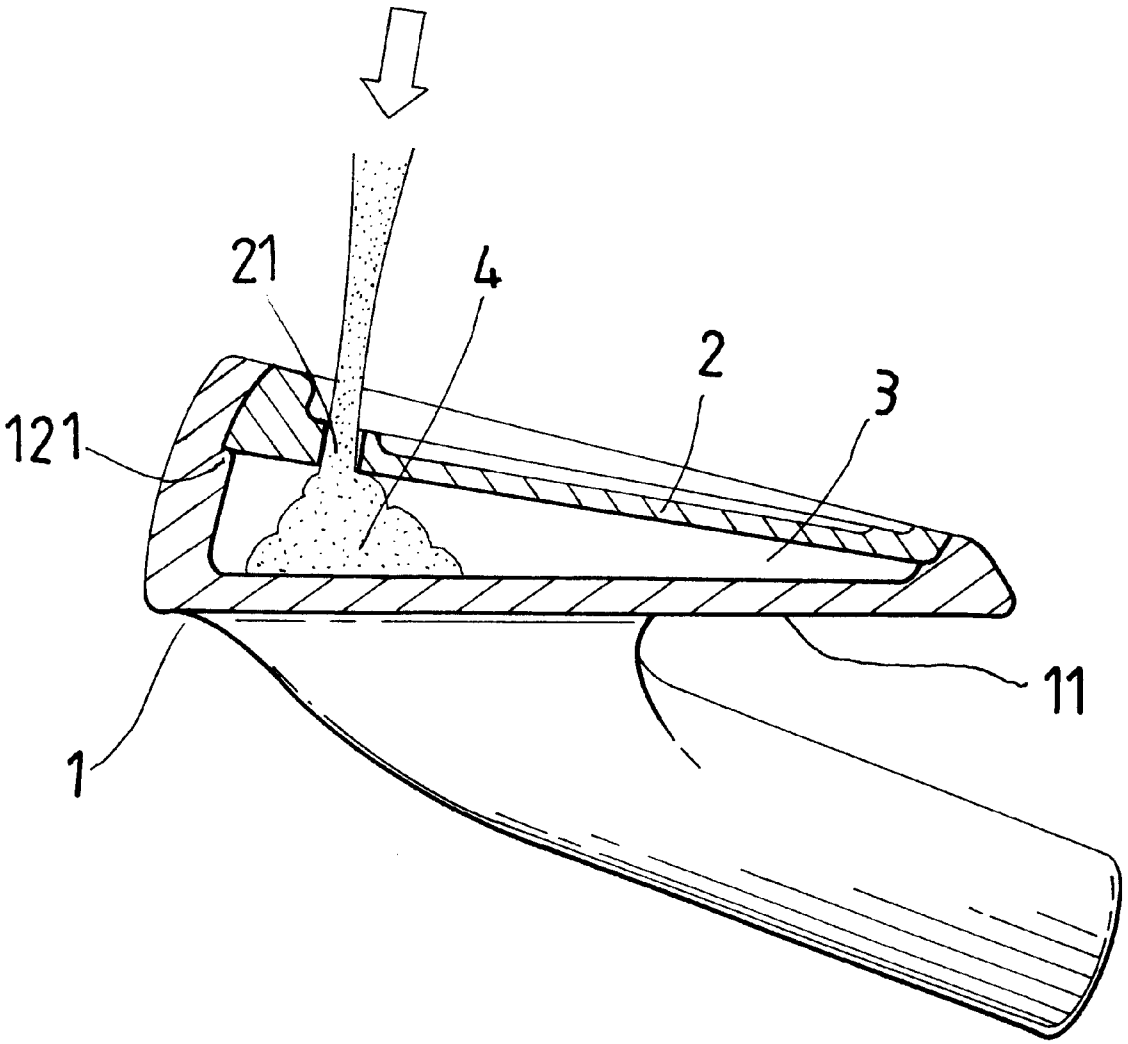
FIG. 3 is cross-sectional view of the golf club head with a non-metal material being filled in a pinched layer in the golf club head.

In assembling this golf club head, referring to FIG. 3, the rear cap 2 is closed in the opening of the hollow room 12, and then pressed inward until the rear cap 2 contact with and rest on the annular projecting edge 121, forming a hollow pinched layer 3 between the rear cap and the hollow room 12. Then the rear cap 2 is fixedly welded with the head body 1. After that, liquid non-metal material 4 such as rubber having a proper softness and hardness is filled through the hole 21 of the rear cap 2 in the hollow pinched layer 3. After the liquid non-metal material 4 in the pinched layer 3 cooled naturally off or is warmed, the material 4 will become a solid buffer block 41, as shown in FIGS. 4 and 5. As the hollow room 12 has a proper inclined angle so that the hole 21 is located just at the highest point of the hollow room 12, permitting the liquid non-metal material 4 filled in the pinched layer 3 and gas therein exhausted out at the same time. The thickness of the buffer block 41 may be 2.5 mm–10 mm, depending on need of various use, design and the size of the hollow room 12 in a golf club head of a different number.

The moment when a user hits a golf ball with the golf club head according to the invention, the buffer block 41 formed in the pinched layer of the golf club head will absorb vibration produced in the golf club head, useful in augmenting stability of the golf club, and preventing sport harm or injury caused by incorrect holding the golf club.

While the preferred embodiment of the invention has been described above, it will be recognized and understood that various modifications may be made therein and the appended claims are intended to cover all such modifications which may fall within the spirit and scope of the invention.

What is claimed is:

1. A golf club head comprising a head body and a rear cap, said head body having a front flat surface formed with plural cut lines to make up a striking face for hitting a golf ball, and characterized by said head body being formed with a recessed hollow room behind said front surface, said hollow room having a tapered sectional profile, a stair shape and an annular projecting edge in an inner surface of said hollow room, said rear cap having a hole and complementary contour to fit closely in an opening of said hollow room and contacting said annular projecting edge of said hollow room, a hollow pinched layer formed between said rear cap and said hollow room after said rear cap is closed on said hollow room, liquid non-metal material being filled in said hollow pinched layer and becoming a solid buffer block after solidifying; said striking face having a thickness between approximately 1.4 mm and 2 mm, said buffer block having a thickness between approximately 2.5 mm and 10 mm; said buffer block being adapted to absorb vibration of said club head thereby enhancing the stability of the golf club and preventing harm in technique or injury to the user from incorrectly holding the golf club.

2. The golf club head as recited in claim 1, wherein when said rear cap is closed fixedly on said head body, said hole of said rear cap is located at the widest point with respect to said tapered sectional contour of said hollow room of said head body to facilitate the exhaustion of gas therethrough during the filling of said non-metal material into said pinched layer.

3. The golf club head as recited in claim 1, wherein after said rear cap is pushed tightly in said hollow room of said head body, said rear cap is welded fixedly with said head body by means of a welding process.

4. The golf club head as recited in claim 1, wherein said non-metal material filled in said pinched layer formed between said head body and said rear cap is rubber having predetermined softness and hardness characteristics.

* * * * *